US007614324B2

(12) United States Patent
Bocquet et al.

(10) Patent No.: US 7,614,324 B2
(45) Date of Patent: Nov. 10, 2009

(54) INTERENGAGED MULTIPLE-DRIP SET OF PLIERS

(75) Inventors: Frédéric Bocquet, Voray sur L'Ognon (FR); Guy Siruguet, Savigny sur Orge (FR)

(73) Assignee: Bost Garnache Industries, Arbois (FR)

( * ) Notice: Subject to any disclaimer, the term of this patent is extended or adjusted under 35 U.S.C. 154(b) by 4 days.

(21) Appl. No.: 12/007,446

(22) Filed: Jan. 10, 2008

(65) Prior Publication Data

US 2008/0236345 A1 Oct. 2, 2008

(30) Foreign Application Priority Data

Jan. 11, 2007 (FR) ..... 07 00208

(51) Int. Cl.
*B25B 7/04* (2006.01)

(52) U.S. Cl. ..... 81/411; 81/355; 81/407; 81/412

(58) Field of Classification Search ..... 81/355, 81/407, 411, 412
See application file for complete search history.

(56) References Cited

U.S. PATENT DOCUMENTS 2,727,417 A 12/1955 Eifel
4,581,960 A * 4/1986 Putsch et al. ..... 81/411
7,455,000 B2 * 11/2008 Lucke et al. ..... 81/412

FOREIGN PATENT DOCUMENTS

| | | |
|---|---|---|
| DE | 1 138 718 | 10/1962 |
| DE | 202 01 841 | 8/2002 |
| EP | 0 528 252 | 2/1993 |

* cited by examiner

*Primary Examiner*—Joseph J Hail, III
*Assistant Examiner*—Shantese McDonald
(74) *Attorney, Agent, or Firm*—Wenderoth, Lind & Ponack, L.L.P.

(57) ABSTRACT

An interengaged multiple-grip set of pliers includes an interengaging arm, an interengaged arm, and an articulation joint. One arm includes an elongated opening which is provided with a first engagement means having a pitch p, and the joint is arranged on the other arm and has a second engagement means. The joint is axially movable between a first position blocking any translation between the arms, and a second axial position allowing translation. The first engagement means and the second engagement means are arranged such that, starting from a first engagement position between the first engagement means and second engagement means, the joint is axially movable beyond the second axial position as far as a third axial position, and can then be moved in rotation about the axis thereof in order to bring the first and second engagement means into engagement in a second engagement position.

13 Claims, 6 Drawing Sheets

INTERENGAGED MULTIPLE-DRIP SET OF PLIERS

BACKGROUND OF THE INVENTION

The present invention relates to an interengaged multiple-grip set of pliers which extends in a general plane. Generally, this type of set includes a first (interengaging) arm which comprises a first jaw, a first intermediate articulation region and a first handle. The interengaging arm has a longitudinal slot in the first articulation region. In addition, a second (interengaging) arm includes a second jaw, a second intermediate articulation region and a second handle. The second articulation region being received, so as to be movable in rotation and selectively in translation, through the longitudinal slot of the first articulation region. Furthermore, an articulation joint is provided in order to articulate the interengaging arm and the interengaged arm. One of the arms includes an elongate opening along an axis in the general plane of the set of pliers, which opening is provided with two longitudinal sides, including first engagement means having a pitch p. The joint is arranged on the other arm and includes a member having second engagement means which are capable of cooperating, by means of shape adjustment, with the first engagement means, which extends along an axis Z-Z which is substantially perpendicular to the axis of the opening.

The member of the joint is movable axially in accordance with the axis Z-Z thereof at least between a first axial position and a second axial position. The first axial position brings the first and second engagement means into engagement and thereby blocks any relative translation movement between the interengaging arm and the interengaged arm. The second position corresponds to the mutual disengagement of the first and second engagement means and thereby allows relative translation movement between the interengaging arm and the interengaged arm.

It is known, in the field of hand tools, to use interengaged multiple-grip sets of pliers which allow the opening of the jaws to be adjusted by pushing an articulation joint axially from a first axial position towards a second axial position and then by means of relative translation of the arms with respect to each other.

In EP-A-528252, the interengaging arm of the interengaged set of pliers comprises an articulation joint comprising two symmetrical toothed profiles which complement the profiled sides of an opening, whose axis is arranged substantially longitudinally on the interengaged arm of the multiple-grip set of pliers.

However, using that multiple-grip set of pliers does not allow precise adjustment of the opening of the jaws. Furthermore, that interengaged set of pliers does not allow ergonomic adjustment of the spacing of the handles in accordance with the size of the hand of the user.

SUMMARY OF THE INVENTION

According to one aspect, an object of the invention is to provide an interengaged multiple-grip set of pliers which can be adjusted precisely in terms of the spacing of the handles and/or the jaws. To that end, the invention relates to an interengaged multiple-grip set of pliers of the above-mentioned type whose first and second engagement means are arranged in such a manner that, starting from a first engagement position in accordance with the axis of the opening between the first and second engagement means, the member of the joint is axially movable beyond the second axial position as far as a third axial position, and can then be moved in rotation about the axis Z-Z thereof in order to bring the first and second engagement means into engagement in a second engagement position in accordance with the axis of the opening allowing, due to distances which are equal to a predetermined fraction of the pitch p, the position of the member in the opening to be adjusted.

The first engagement means includes, on each of the two longitudinal sides of the opening, a series of successive peaks which are separated by troughs, the series being identical and longitudinally displaced relative to each other in such a manner that a peak of one series faces a trough of the other series. The second engagement means include at least two series of teeth having a profile which complements that of the first engagement means, the second engagement means being capable of carrying out a rotation relative to the axis Z-Z of the member of the joint, once the first engagement means and the second engagement means have been mutually disengaged, and of moving back into mutual engagement after that rotation.

The second engagement means includes two series of teeth which are opposite and displaced relative to each other by a half-pitch p, and are capable of carrying out a rotation through 180° in the third axial position.

The interengaging arm includes a partition at one side and the other of the longitudinal slot, in one of which partitions there is arranged an opening which is intended to guide the articulation joint, and the interengaged arm comprises the elongate opening.

The successive peaks and troughs are of identical shape and size and are provided in accordance with a constant pitch p.

The articulation joint includes a member which is intended to support a thrust effort, in particular a cover.

The thrust member includes a reference marking for indicating the angular position thereof.

The partition of the interengaging arm including a receiving recess which is adjacent to the thrust member further includes a plurality of differentiated markings, in particular two markings which are diametrically opposite with respect to the articulation joint. By the member of the articulation joint being rotated, the reference marking of the thrust member faces one of the markings of the interengaging arm. The articulation joint comprises gripping notches which are provided opposite the thrust member. The interengaged arm has a quasi-constant thickness over the majority of the length thereof and as far as the end opposite the jaw thereof. At least one end-plate is applied to the handle of the interengaged arm, in particular two end-plates, each end-plate being applied to a side of the handle of the interengaged arm. The articulation joint can further include a shaft which extends along the axis Z-Z of the member of the joint, relative to which shaft the interengaging arm pivots. The shaft is laterally displaced by d relative to the axis of the elongate opening.

According to another aspect, an object of the invention is to reduce the shear stresses of the articulation joint. This problem is solved in that, in an interengaged multiple-grip set of pliers of the type set out above, the second engagement means includes two series of teeth which are opposed and displaced relative to each other by a half-pitch p, and are capable of carrying out a rotation through 180° in the third axial position.

In this manner, the opening has profiled sides which are asymmetrical relative to the axis of the opening and whose spacing is constant.

According to another aspect, an object of the invention is to facilitate the assembly of the interengaged arm in the longitudinal opening of the interengaging arm.

This problem is solved in that, in an interengaged multiple-grip set of pliers of the type set out above, the interengaged arm has a quasi-constant thickness over the majority of the length thereof and as far as the end opposite the jaw thereof.

In greater detail, at least one end-plate is provided in order to increase the thickness of the handle portion. In this manner, at least one end-plate is applied to the handle of the interengaged arm, in particular two end-plates, each end-plate being applied to one side of the handle of the interengaged arm.

BRIEF DESCRIPTION OF THE DRAWINGS

The invention will now be described in a non-limiting manner with reference to the appended Figures, in which.

DETAILED DESCRIPTION OF THE PREFERRED EMBODIMENT

Figure 1:
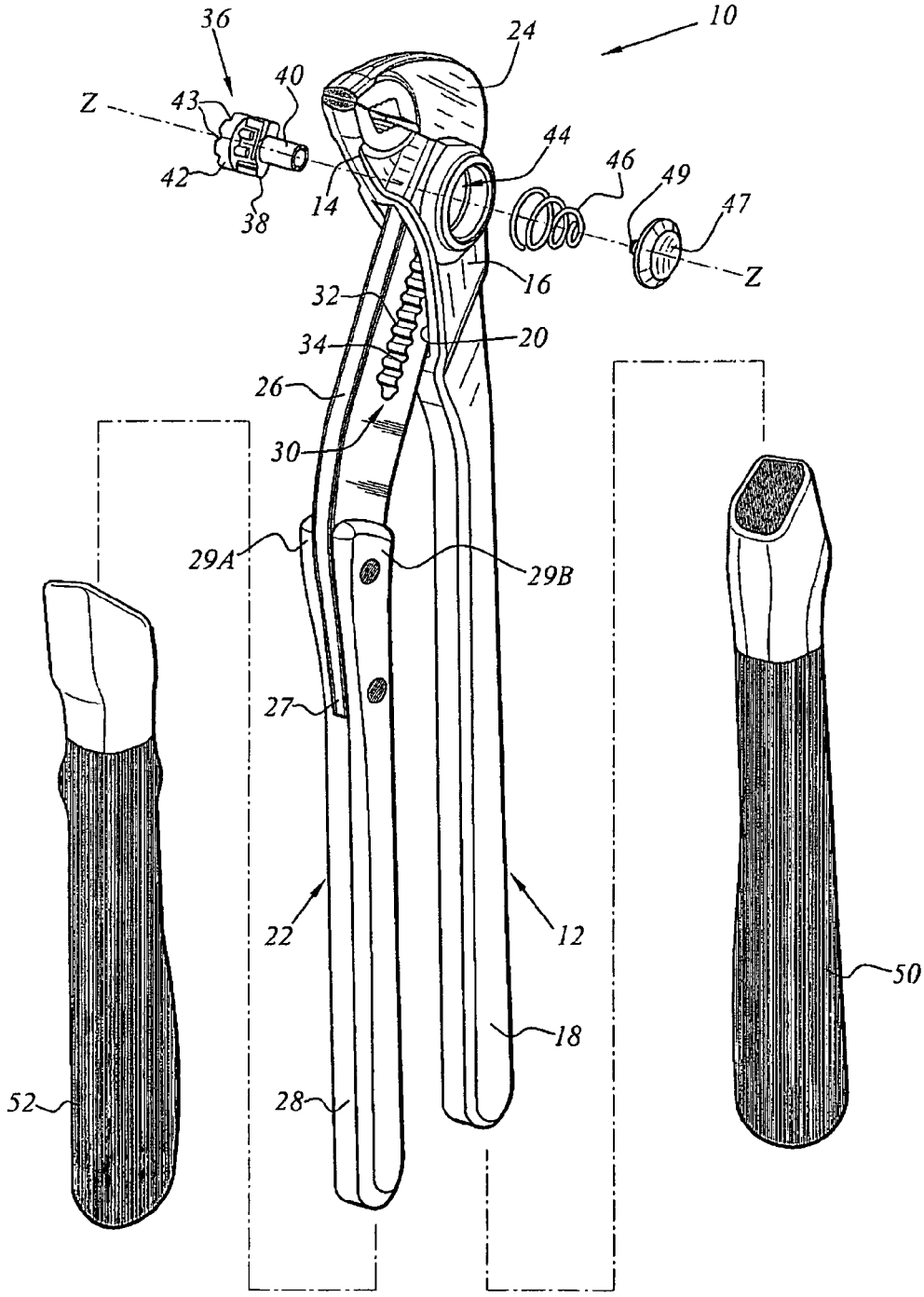
FIG. 1 is an exploded perspective view of the interengaged multiple-grip set of pliers according to the invention.

The tool of FIG. 1 is a multiple-grip set of pliers 10 which extends in a general plane. It is of the interengaged type and comprises an interengaging (first) arm 12 which comprises a first jaw 14, a first intermediate articulation region 16 and a first handle 18. The interengaging arm 12 has a longitudinal opening 20 which is provided in the first articulation region 16. The set of pliers 10 also comprises an interengaged (second) arm 22 which comprises a second jaw 24, a second intermediate articulation region 26 and a second handle 28. The second articulation region 26 is received so as to be movable in rotation (pivot) and selectively in translation through the longitudinal opening 20 of the first articulation region 16.

In the example illustrated in FIG. 1, the interengaged arm 22 comprises a proximal portion 27 of the second handle 28 that is reduced in terms of length. The interengaged arm 22 has a quasi-constant thickness over the majority of the length thereof, that is to say, from the second jaw 24 to the end of the proximal portion 27 of the handle 28, which allows the interengaged arm 22 to pass into and through the longitudinal opening 20 of the interengaging arm 12. The thickness of the second intermediate articulation region 26 of the interengaged arm 22 is calibrated, to within play tolerances, relative to the width of the longitudinal opening 20. When the set of pliers 10 is assembled, the proximal portion 27 of the handle 28 is introduced through the opening 20, and two respective end-plates 29A and 29B are fitted and fixedly joined to that proximal portion 27 of the handle 28 by known means such as welding or riveting in order to form the second handle 28. That arrangement allows a reduction in play in the articulation region of each of the arms and improves the perception, by the user, of precise guiding of the arms of the set of pliers with respect to each other.

An elongated opening 30 extends along the longitudinal axis of the second intermediate articulation region 26. It is provided with two profiled longitudinal sides 32 and 34 which are substantially parallel.

The set of pliers 10 further comprises an articulation joint 36 which extends along an axis Z-Z which is perpendicular to the general plane of the set of pliers. The joint 36 articulates the interengaging arm 12 and the interengaged arm 22. It comprises a member or pinion 38 which extends, in a first direction, by means of a protruding pin 39 (FIGS. 4A and 4B), and, in a second direction opposite the first direction of the pin 39, by means of a hollow shaft 40. The protruding pin 39 and the hollow shaft 40 have circular cross-sections with a center 41 carried by the axis Z-Z (FIG. 6), and they are integral with the pinion 38. A washer 42, which is also circular, is fixedly joined to the pinion 38 by force-fitting or snap-riveting onto the protruding pin 39.

In a variant which is not illustrated, the pinion 38 and the washer 42 are constructed in one piece, for example, by metal injection moulding (MIM).

The washer 42 comprises external notches 43 which improve the capacity for being gripped. The pin 39, the hollow shaft 40 and the washer 42 are coaxial and are constructed so as to be able to revolve about the axis Z-Z.

A recess 44 is arranged externally on a first partition 16A (FIGS. 4A and 4B) which laterally delimits the longitudinal opening 20 of the intermediate region 16 of the interengaging arm 12. A hole 45 (FIGS. 4A and 4B) is provided, opposite the recess 44, through the second partition 16B (FIGS. 4A and 4B) which is lateral with respect to the opening 20. The recess 44 and the hole 45 have circular cross-sections and are coaxial. The hole 45 has a shape complementary to the washer 42, to within play tolerances, and receives washer 42 so as to guide it in terms of rotation and translation. The recess 44 receives in abutment the widened end turn of a conical helical spring 46. The turn at the opposite end of the spring 46, having a reduced diameter, abuts against the internal face 48 (FIGS. 4A and 4B) of an abutment member 47 in the form of a cover. A pin 49 extends from the internal face 48 of the cover 47 and is fixedly joined to the hollow shaft 40 of the articulation joint 36 by resilient snap-fitting or force-fitting.

The interengaging arm 12 pivots about the articulation joint 36. The pinion 38 cooperates, by means of shape adjustment, with the profiled sides 32 and 34 of the opening 30 of the intermediate articulation region 26 of the arm 22.

Sheaths 50 and 52 cover the first handle 18 and the second handle 28, respectively.

Figure 2A:
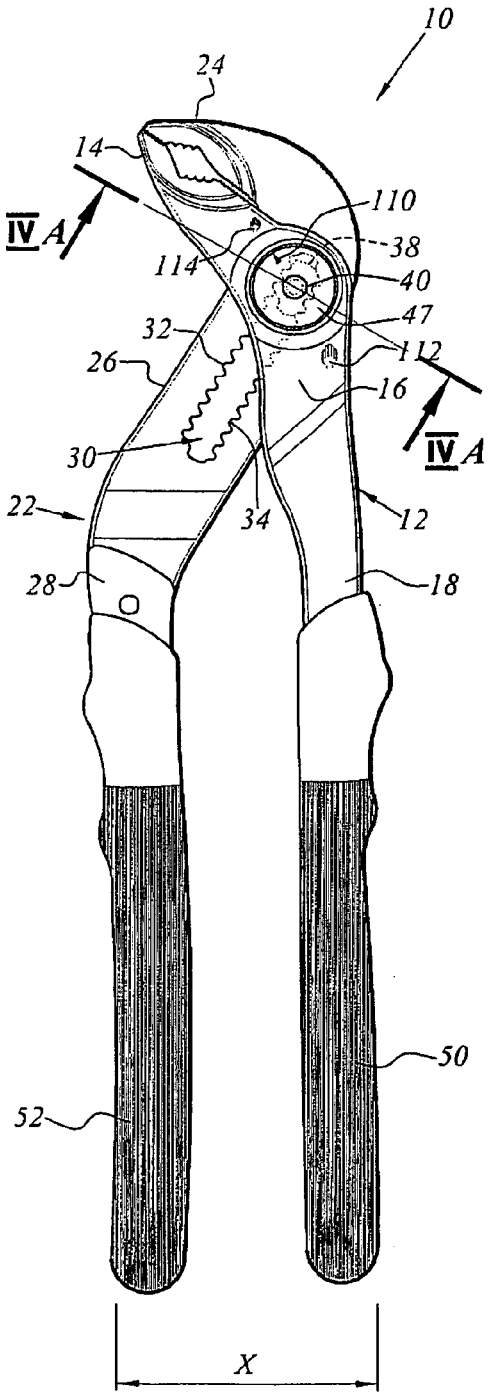
FIG. 2A is a front view of the set of pliers of FIG. 1, showing a position of the handles with reduced spacing.
Figure 2B:
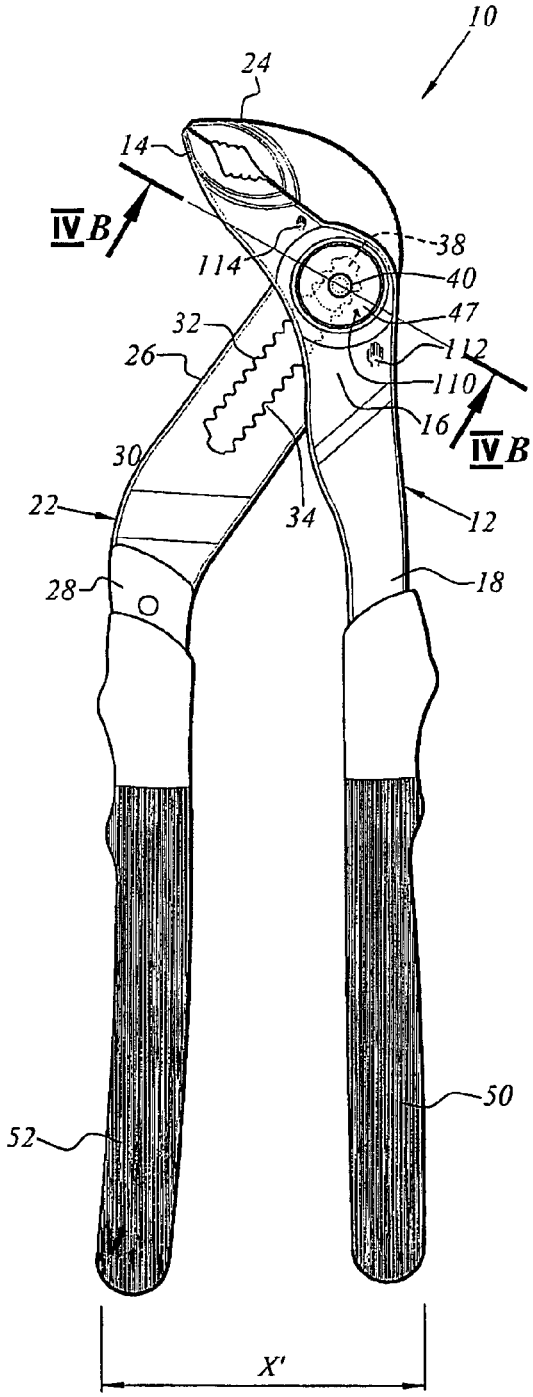
FIG. 2B is a view similar to FIG. 2A showing increased spacing of the handles.

The FIGS. 2A and 2B illustrate the interengaged multiple-grip set of pliers 10 in two different configurations. Although the spacing of the first jaw 14 and the second jaw 24 is similar in the configurations illustrated, with zero spacing of the free ends of the jaws 14 and 24, the spacing of the first handle 18 and the second handle 28 is substantially different.

In this manner, the spacing X between the handles 18 and 28, measured half-way along the sheaths 50 and 52, is approximately 50 mm in the configuration of the set of pliers 10 illustrated in FIG. 2A. In comparison, the spacing X' between the handles 18 and 28, measured under the same conditions, is approximately 58 mm in the configuration of the set of pliers 10 illustrated in FIG. 2B. Those spacings are measured for a set of pliers 10 having a total length of approximately 250 mm.

To that end, the pinion 38 which cooperates with the profiled sides 32 and 34 of the opening 30, is arranged axially in the opening 30 in two different positioning configurations along the longitudinal axis of the opening 30. These positions are illustrated in the FIGS. 3A and 3B, in which the interengaging arm 12 is illustrated as a dot-dash line for the sake of clarity of the drawings.

The elongated opening 30 is defined, at one side, by the longitudinal profiled sides 32 and 34 and, at the other side, by an end surface 60 arranged at the end side closest to the handles 18 and 28 and by an end surface 62 arranged at the end side closest to the jaws 14 and 24.

Figure 3A:
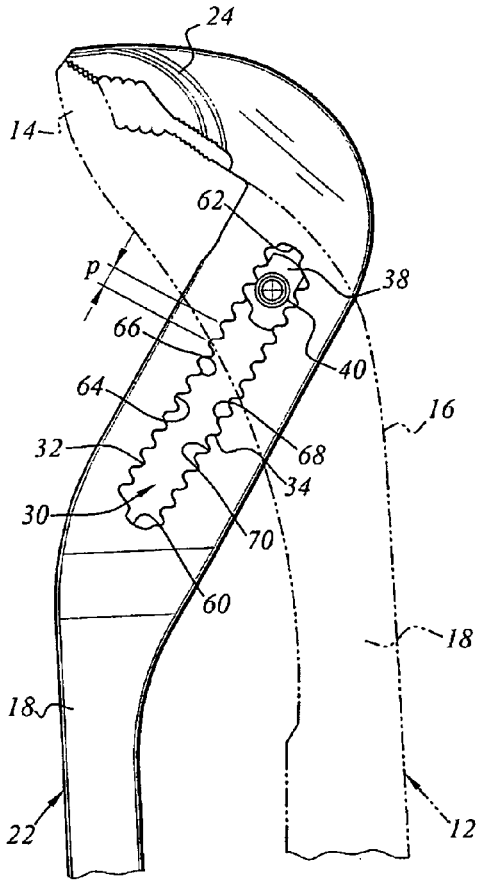
FIGS. 3A and 3B are front views, drawn in an enlarged scale, of the intermediate articulation regions of the multiple-grip set of pliers of FIGS. 2A and 2B, respectively.
Figure 3B:
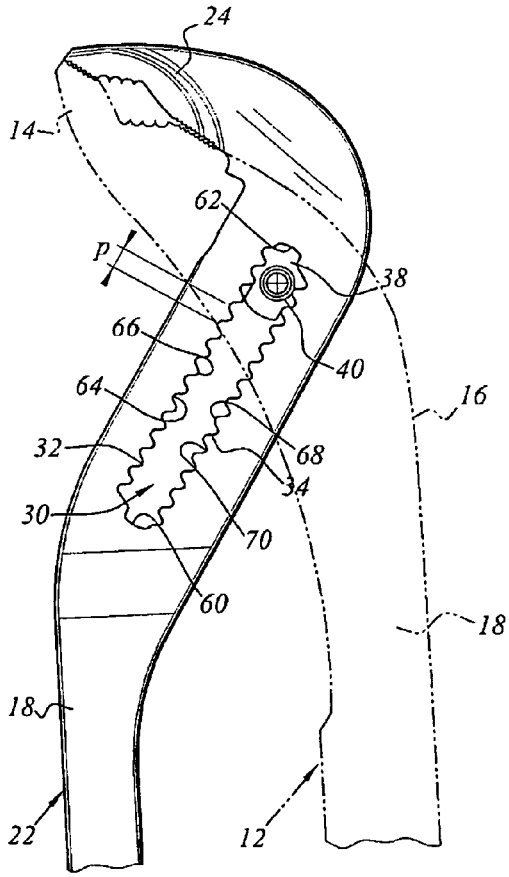

In FIGS. 3A and 3B, the profiled sides 32 and 34 of the opening 30 each have a wave-like shape of pitch p, alternating between troughs and peaks of constant dimensions. The profiled side 32 is arranged at the side closest to the jaws 14 and 24 of the set of pliers 10 and thus comprises, in an alternating manner, troughs 64 and peaks 66. Similarly, the profiled side 34 which is arranged at the side closest to the handles 18 and 28 has, in an alternating manner, peaks 68 and troughs 70 having the same dimensions as the troughs 64 and peaks 66 of the profiled side 32. It should be noted that the pitch p of the wave is constant and identical over the profiled sides 32 and 34. It should also be noted that peaks and troughs have rounded shapes. The arrangement of the troughs 64 and the peaks 66 of the profiled side 32 and that of the peaks 68 and the troughs 70 of the profiled side 34 are such that a trough 64 of the profiled side 32 faces a peak 68 of the profiled side 34. Similarly, a peak 66 of the profiled side 32 faces a trough 70 of the profiled side 34.

In this manner, the opening 30 does not have, as in the prior art, two symmetrical profiled sides which together comprise, in an alternating manner, narrowed portions and widened portions. Instead, the profiled sides 32 and 34 are displaced (offset) by a half-pitch p along the longitudinal axis of the opening 30 in such a manner that they have a constant spacing between the troughs and the peaks along the entire length of that opening, which contributes to an improvement in the shear-resistance of the members of the articulation regions of the set of pliers.

Figure 6:
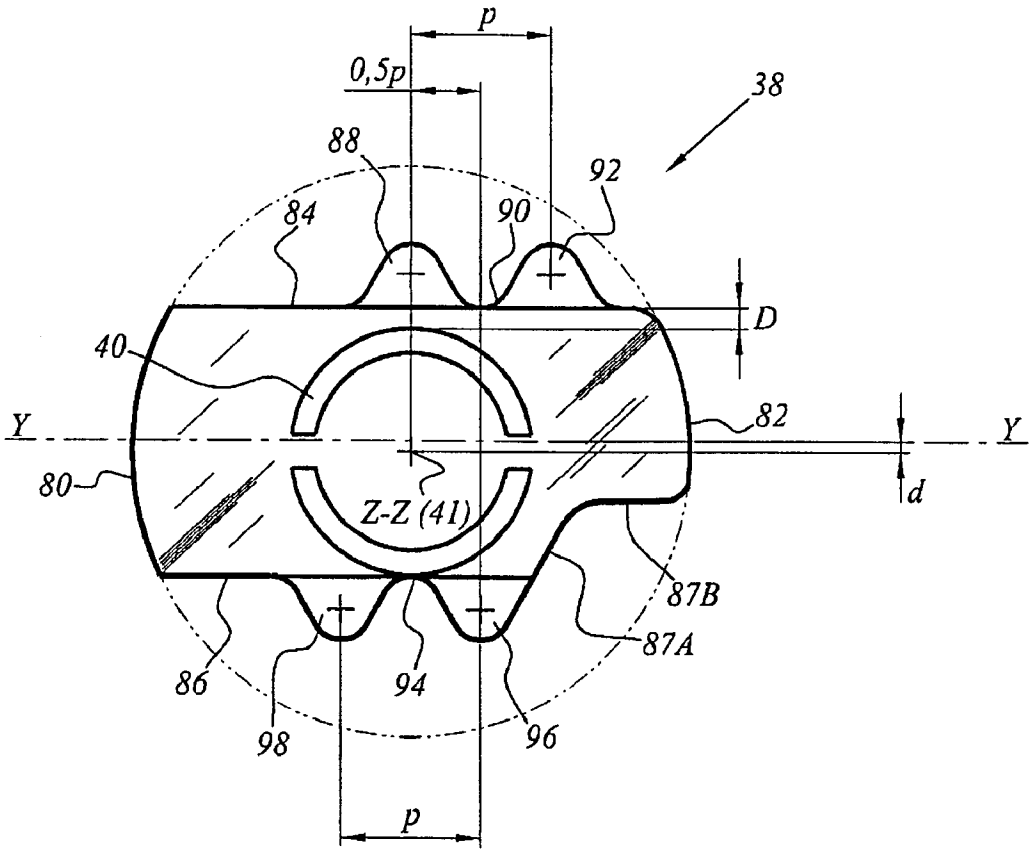
FIG. 6 is a top view, drawn to an enlarged scale, of the pinion of the articulation joint of the interengaged multiple-grip set of pliers of FIG. 1.

As illustrated in FIG. 6, the member or pinion 38 also extends along an axis Y-Y which is perpendicular to the axis Z-Z. The axis Y-Y coincides with the longitudinal axis of the elongated opening 30 of the interengaged arm 22 when the member or pinion 38 is assembled in the opening 30. The member or pinion 38 is delimited by a first arcuate end face 80 which is centred on the location 41 and whose radius is equal to that of the washer 42. It is delimited, opposite the first end face 80, by a second arcuate end face 82, which is centered on the center location 41 and which has a radius equal to that of the washer 42. The center location 41 of the end faces 80 and 82 is displaced laterally by a distance d relative to the axis Y-Y of the pinion 38, and the chord of the end face 82 is less than that of the end face 80.

The end face 82 of the pinion 38 has a shape which complements those of the end faces 60 and 62 of the opening 30.

The pinion 38 is also delimited by two flattened planar faces 84 and 86 which extend at one side and the other of the hollow shaft 40. The flattened faces 84 and 86 are parallel and spaced apart by a dimension which is slightly less than that between the peaks of the profiled sides 32 and 34 of the opening 30. The flattened face 84, which is long, connects the end faces 80 and 82. The flattened face 86, which is shorter than the face 84, joins the end face 80 and extends over approximately two-thirds in the direction of the end face 82. It joins an oblique face 87A which is directed towards the axis Y-Y of the pinion 38 and which itself joins a face 87B which is substantially parallel with the face 86. The face 87B joins the end face 82. The pinion 38 thus has an asymmetrical contour which acts as a device to promote correct assembly of the set of pliers.

It should be noted that the hollow shaft 40 is not arranged symmetrically relative to the planar faces 84 and 86. It has a displacement D, which is equal to 2d, of approximately 0.5 mm relative to the surface 84 which directly connects the end surfaces 80 and 82, and the advantage of this displacement will be described below. The external surface of the hollow shaft 40 which is diametrically opposed to the face 84 is aligned with the planar surface 86.

The pinion 38 further comprises, on each of the flattened planar faces 84 and 86, a series of troughs and peaks of wave-like shape which complements that of the troughs and peaks of the profiled sides 32 and 34 of the opening 30.

The flattened planar face 84 has, over more than two-thirds of the height of the face, facing the center location 41 of the hollow shaft 40, a peak 88 which is followed, in the direction of the arcuate end face 82, by a trough 90 whose base is arranged in the plane of the face 84. Trough 90 is followed, in the direction of the arcuate displaced end face 82, by a second peak 92 which joins the end face 82.

The flattened face 86, opposite the preceding face 84, has, over more than two-thirds of the height of the face, facing the center location 41 of the hollow shaft 40, a trough 94 whose base is arranged in the plane of the flattened surface 86. In the direction of the end face 82, the trough 94 is followed by a peak 96 which itself joins the oblique surface 87A. In the direction of the curved end surface 80, the trough 94 is extended by a peak 98, that peak joining the flattened face 86.

In this manner, two series of troughs and peaks are arranged at one side and the other of the hollow shaft 40 and are provided in such a manner that the peak 88 arranged on the long face 84 faces (is opposite) a trough 94 arranged on the face 86. Similarly, the trough 90, which is arranged on the long face 84, faces (is opposite) the peak 96 arranged on the short face 86. The peak 92 of the long face 84 is arranged substantially facing (opposite) the oblique face 87A, and the peak 98 of the short face 86 is arranged facing (opposite) the zone for connecting the peak 88 of the long face 84 thereto.

In FIG. 3A, the orientation of the pinion 38 is such that the short face 86 is directed towards the jaws 14 and 24, while the long face 84 is directed towards the handles 18 and 28. In this configuration, the end face 80 of the pinion 38 is located adjacent to and spaced-apart from the end face 62 of the opening 30 which is positioned at the side of the jaws 14 and 24. The pinion 38 is blocked, along the longitudinal axis of the opening 30, in a position preceding the extreme position at the side of the jaws 14 and 24. The hollow shaft 40 is displaced at the side of the jaws 14 and 24 relative to the longitudinal axis of the opening 30.

In FIG. 3B, the orientation of the pinion 38 is transposed: the long face 84 is directed towards the jaws 14 and 24, while the short face 86 is directed towards the handles 18 and 28. In this configuration, the end face 82 of the pinion 38 is subjected to shape adjustment with the end face 62 of the opening 30 positioned at the side of the jaws 14 and 24. That arrangement allows the pinion 38 to access, along the longitudinal axis of the opening 30, the extreme axial position at the side of the jaws 14 and 24. The hollow shaft 40 is displaced at the side of the handles 18 and 28 relative to the longitudinal axis of the opening 30.

Consequently, in FIG. 3A, the intermediate articulation region 16 of the interengaging arm 12 tends to move towards the handle 28 of the interengaged arm 22. In FIG. 3B, the intermediate articulation region 16 of the interengaging arm 12 tends to move away from the handle 28 of the interengaged arm 22.

Taking into consideration the displacement of the series of peaks and troughs present, both on the profiled sides 32 and 34 and on the flattened faces 84 and 86 of the pinion 38, the pinion 38 can be moved in the axial direction of the opening 30 by a fraction of a pitch p. In particular, in the example illustrated, the pinion 38 can move by a half-pitch p, towards the end face 62 arranged at the side of the jaws 14 and 24. It is thereby advantageous to obtain, with a constant dimension in terms of the jaws 14 and 24, variable spacing in terms of the handles 18 and 28. In the same manner as before, with constant spacing of the handles 18 and 28, it is advantageous to be able to adjust, to within a fraction of a pitch p, the spacing between the jaws 14 and 24.

It should be noted that the lateral displacement D of the hollow shaft 40 relative to the long guiding surface 84 and the displacement d=D/2 relative to the axis 41 allow the free ends of the jaws 14 and 24 to be aligned substantially in the same plane when the pinion 38 is rotated through 180°.

This arrangement is advantageous in order to improve the gripping of objects at the end of the jaws, whatever the configuration of the set of pliers.

Figure 4A:
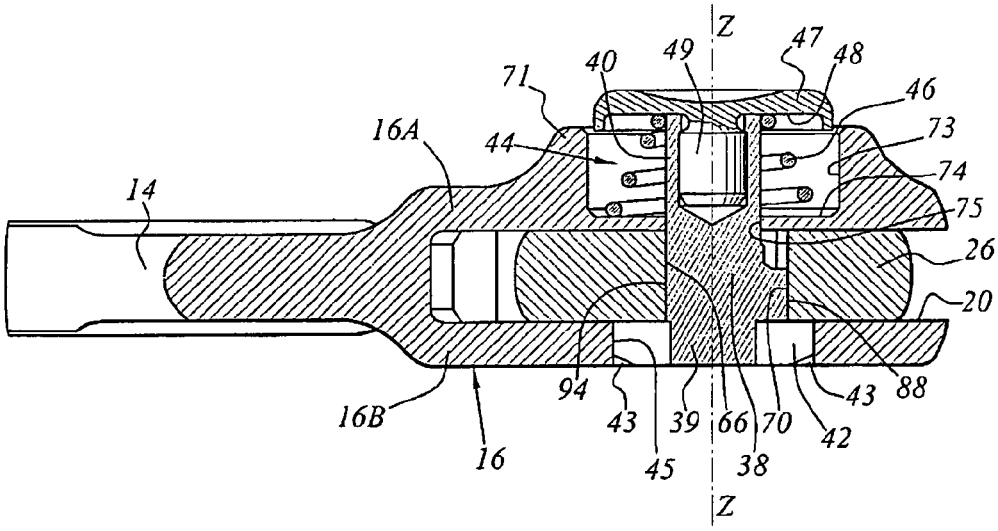
FIGS. 4A and 4B are sectional views along the lines IVA-IVA and IVB-IVB of the multiple-grip sets of pliers of FIGS. 2A and 2B, respectively.
Figure 4B:
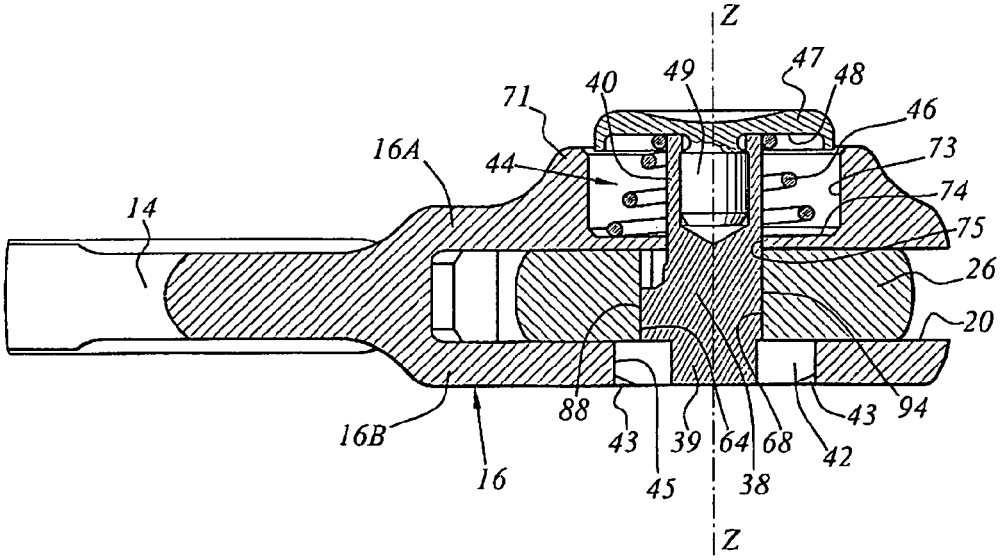

As illustrated in FIGS. 4A and 4B, the recess 44 is obtained from a collar 71 which projects from the partition 16A of the intermediate articulation region 16. The recess 44 is in the form of a hole comprising a circular lateral surface 73 and a base 74, against which the spring 46 abuts. An opening 75 is provided in the base 74 in order to receive the hollow shaft 40, to within play tolerances, and to guide it in terms of rotation and translation in accordance with the axis Z-Z.

In FIG. 4A, the peak 66 of the profiled side 32 is in engagement with the trough 94 of the short flattened face 86 of the pinion 38. Diametrically opposite the hollow shaft 40, the peak 88 of the long flattened face 84 of the pinion 38 is in engagement with a trough 70 of the profiled side 34 of the opening 30.

In FIG. 4B, the same peak 88 of the long flattened face 84 of the pinion 38 is in engagement with a trough 64 of the profiled side 32 of the opening 30. Diametrically opposite the hollow shaft 40, the trough 94 of the short flattened face 86 of the pinion 38 is in engagement with a peak 68 of the profiled side 34 of the opening 30.

There will now be described the steps allowing the pinion 38 to move successively from its configuration illustrated in FIG. 4A to the configuration illustrated in FIG. 4B.

Figure 5A:
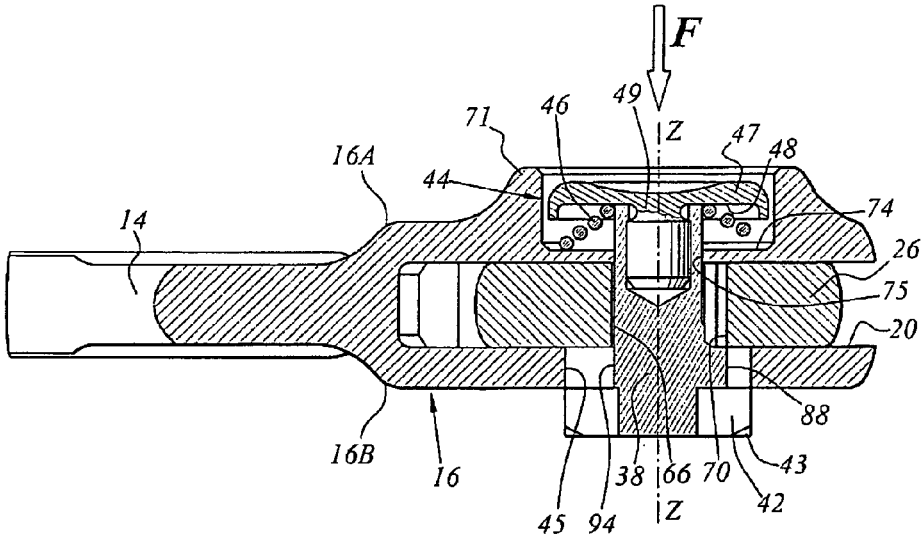
FIGS. 5A and 5B illustrate the steps for precise adjustment of the multiple-grip set of pliers of FIG. 1.

In its configuration illustrated in FIG. 4A, the pinion 38 and the profiled sides 32 and 34 of the opening 30 are mutually engaged, the pinion 38 occupying a first axial position which is perpendicular to the general plane of the set of pliers, and in which the cover (abutment member) 47 projects out of the recess 44. By pressing on the cover 47 in accordance with the arrow F illustrated in FIG. 5A and tending to move the cover 47 to a position approximately half-way down the recess 44, the user displaces the pinion 38 in such a manner that the means for engaging the pinion 38 and those of the profiled sides 32 and 34 of the opening 30 become mutually disengaged. The pinion 38 occupies a second axial position, which is perpendicular to the general plane of the set of pliers, illustrated in FIG. 5A. The engagement means of the pinion 38 are located facing the hole 45 which is formed in the partition 16B of the intermediate articulation region 16 of the interengaging arm 12. It should be noted that the guiding in terms of translation is brought about, on the one hand, by the external surface of the hollow shaft 40 cooperating with the internal surface of the opening 75 and, on the other hand, by the external surfaces of the washer 42 and the arcuate end faces 80 and 82 of the pinion 38 cooperating with the internal surface of the hole 45.

In this second axial position of the pinion 38, perpendicular to the general plane of the set of pliers, the complementary nature of the height of the flattened faces 84 and 86, excluding the peaks and troughs, allows the pinion 38 to be guided in translation in the axial direction of the opening 30 between the peaks of the profiled sides 32 and 34 of the opening 30.

Figure 5B:
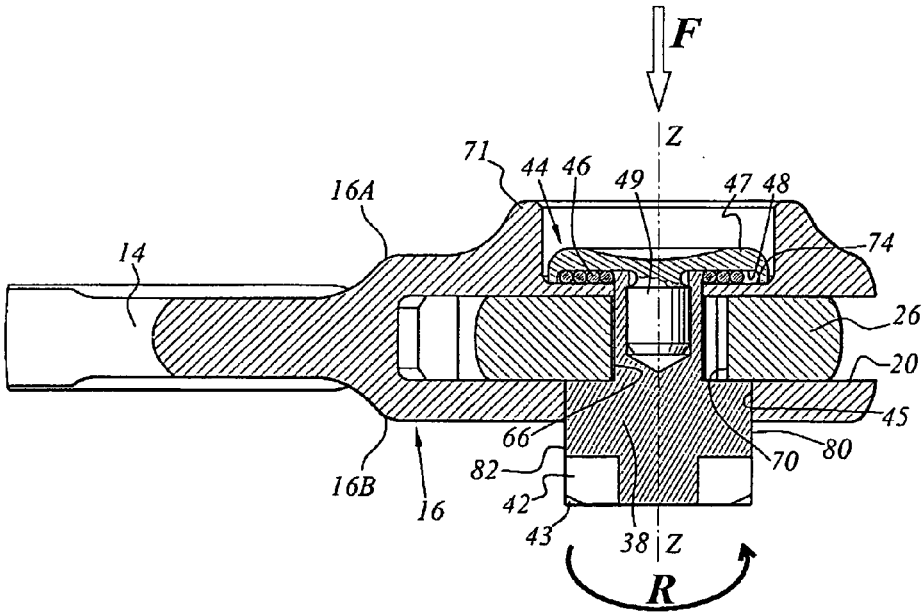

By continuing to push on the cover 47 in accordance with the arrow F illustrated in FIG. 5B, the user substantially positions the cover 47 in abutment against the base 74 of the recess 44, compressing to a maximum the conical spring 46 between that base 74 and the internal face 48 of the cover 47.

In this new axial position, perpendicular to the general plane of the set of pliers, the arcuate end faces 80 and 82 of the pinion 38 are arranged facing the internal surface of the hole 45. The user, while maintaining the pressure which tends to cause the cover 47 to abut the base 74 of the recess 44, manipulates the washer 42 which is fixedly joined to the pinion 38 in such a manner as to rotate the pinion 38 through a half-turn relative to the axis Z-Z. In FIG. 5B, the rotation is underway and represents approximately 90°, with the curved end faces 80, 82 of the pinion 38 acting as a guide in terms of rotation in the hole 45.

Once the rotation through 180° relative to the axis Z-Z has been carried out, the user relaxes the pressure on the cover 47, which tends to move the engagement means of the pinion 38 and those of the profiled sides 32 and 34 of the opening 30 closer to each other. The user manually carries out a displacement through a half-pitch p, tending to align the engagement means of the pinion 38 and those of the profiled sides 32 and 34 of the opening 30. With the pressure on the cover 47 being completely relaxed, the user mutually engages, by means of shape adjustment, the engagement means of the pinion 38 and those of the profiled sides 32 and 34 of the opening 30.

In this manner, the number of adjustment positions of the pinion 38 in accordance with the longitudinal axis of the opening 30 is doubled with respect to a conventional set of pliers, because, based on an initial adjustment position of the pinion 38, there is provided an adjustment position at a half-pitch p at one side and the other of the initial position simply by rotating the pinion through 180° about the axis Z-Z.

As illustrated in FIGS. 2A and 2B, in order to facilitate the reference system for orientating the pinion 38 for the user, a marking 110 such as an arrow which is orientated radially outwardly, is positioned on the external face of the cover 47 in a visible manner. The reference marking 110 allows the angular positioning of the cover 47 relative to the axis Z-Z. Differentiated markings 112 and 114 are arranged so as to be diametrically opposite the circular recess 44. The first differentiated marking 112, such as a hand, is positioned, at the side of the handle 18 and in a visible manner, on the external face of the partition 16A of the intermediate articulation region 16 of the interengaging arm 12. A second differentiated marking which has smaller dimensions than the first marking, such as a hand, is positioned, on the same external face of the partition 16A, at the side of the jaw 14 of the interengaging arm 12. In this manner, it is easy for the user to position the pinion 38 in one of the configurations leading to greater or lesser spacing of the handles 18 and 28 of the set of pliers.

The preceding description has been given within the context of the adjustment of the spacing of the handles of an interengaged multiple-position set of pliers, with constant spacing in terms of the jaws of the same set of pliers. It is apparent that the device described above is advantageous for adjusting the spacing of the jaws of a set of pliers, with constant spacing in terms of the handles of the same set of pliers. That facilitates the repetitive use of the tool.

Such a set of multiple-grip pliers allows gripping, in terms of the jaws, of heads of screwed fixing elements both with metric dimensions and with imperial dimensions.

The preceding description has been given within the context of an adjustment of the position of the pinion 38 in the opening 30 to within a half-pitch p, by means of a rotation of the pinion 38 through 180°. Therefore, the device described is advantageous for adjusting the position of the pinion 38 in the opening 30 to within a fraction of the pitch p, by means of a rotation of the pinion 38 through a fraction of 360°, the fractions being equal.

Due to the invention, it is possible to adjust precisely the spacing of the handles of a set of pliers and/or the spacing of the jaws of that set of pliers.

What is claimed is:

1. A multiple-grip set of pliers comprising:

an interengaging arm including a first jaw, a first intermediate articulation region having a longitudinal slot therein, and a first handle;

an interengaged arm including a second jaw, a second intermediate articulation region, and a second handle, said second articulation region being received through said longitudinal slot of said first articulation region so as to be rotatable and movable along said longitudinal slot, said interengaged arm having an elongated opening with a first axis in a plane of said interengaged arm, said elongated opening having two longitudinal sides comprising a first engagement means having a pitch; and an articulation joint articulating said interengaging arm and said interengaged arm, said articulation joint being arranged on said interengaging arm and including a body having second engagement means operable to cooperate by position adjustment with said first engagement means, said body arranged to extend along a second axis substantially perpendicular to said first axis of said elongated opening;

wherein said body of said articulation joint is operable to move along said second axis between a first axial position and a second axial position, said first engagement means and said second engagement means being engaged so as to thereby prevent any relative translation movement between said interengaging arm and said interengaged arm when said articulation joint is in said first axial position, said first engagement means and said second engagement means being disengaged so as to thereby allow relative translation movement between said interengaging arm and said interengaged arm via said longitudinal slot when said articulation joint is in said second axial position; and wherein said interengaging arm, said interengaged arm, and said articulation joint are arranged such that, starting from a first engagement position along said first axis of said elongated opening, said body of said articulation joint is axially movable beyond said second axial position to a third axial position, said articulation joint being axially rotatable about said second axis in said third axial position, and said body of said articulation joint is axially movable from said third axial position back to said second axial position whereat said first engagement means and said second engagement means engage each other at a second engagement position offset from said first engagement position along said first axis so as to allow a position of said body along said first axis to be adjusted by a distance equal to a predetermined fraction of said pitch.

2. The multiple-grip set of pliers of claim 1, wherein said first engagement means comprises a series of alternating peaks and troughs on each of said two longitudinal sides of said elongated opening, said series of alternating peaks and troughs of a first one of said two longitudinal sides being identical to and longitudinally offset relative to said series of alternating peaks and troughs of a second one of said two longitudinal sides such that a peak of said series of alternating peaks and troughs of said first one of said two longitudinal sides faces a trough of said series of alternating peaks and troughs of said second one of said two longitudinal sides faces, and said second engagement means comprises at least two series of teeth each having a profile complementary to a profile of said first engagement means, said second engagement means being shaped and arranged to rotate about said second axis of said body of said articulation joint when said first engagement means and said second engagement means are disengaged, and said second engagement means is shaped and arranged to move back into engagement with said first engagement means after rotation about said second axis.

3. The multiple-grip set of pliers of claim 2, wherein said series of alternating peaks and troughs have an identical shape and size, and are arranged so as to have a constant pitch.

4. The multiple-grip set of pliers of claim 3, wherein said articulation joint further includes gripping notches opposite a thrust member.

5. The multiple-grip set of pliers of claim 1, wherein said second engagement means comprises two series of opposing teeth on said articulation joint, said two series of opposing teeth being offset relative to each other by a half-pitch, and said opposing teeth being operable to be rotated through 180° when said articulation joint is in said third axial position.

6. The multiple-grip set of pliers of claim 1, wherein said interengaging arm comprises a pair of partitions arranged such that one of said pair of partitions is located at each side of said longitudinal slot, one of said pair of partitions having an opening for guiding said articulation joint.

7. The multiple-grip set of pliers of claim 1, wherein said articulation joint comprises a thrust member for supporting a thrust effort.

8. The multiple-grip set of pliers of claim 7, wherein said interengaging arm comprises a pair of partitions arranged such that one of said pair of partitions is located at each side of said longitudinal slot, one of said pair of partitions including a receiving recess adjacent to said thrust member, said receiving recess having two markings diametrically opposite each other with respect to said articulation joint.

9. The multiple-grip set of pliers of claim 7, wherein said thrust member has a reference marking for the angular position thereof.

10. The multiple-grip set of pliers of claim 9, wherein, as said body of said articulation joint is rotated, said reference marking of the thrust member can be positioned to face a marking of said interengaging arm.

11. The multiple-grip set of pliers of claim 1, wherein said interengaged arm has a quasi-constant thickness over a majority of a length of said interengaged arm extending to end of said interengaged arm opposite said second jaw.

12. The multiple-grip set of pliers of claim 1, wherein said second handle of said interengaged arm has two end plates, each of said end plates being located at a respective side of said second handle of said interengaged arm.

13. The multiple-grip set of pliers of claim 1, wherein said articulation joint further comprises a shaft extending along said second axis of said body of said articulation joint, said interengaging arm being arranged to pivot relative to said shaft, and said shaft being laterally displaced relative to said first axis of said elongated opening.

* * * * *